US008997268B2

(12) United States Patent
Miller et al.

(10) Patent No.: US 8,997,268 B2
(45) Date of Patent: Apr. 7, 2015

(54) FLUSH TOILET CONTROL SYSTEM AND RELATED METHOD

(75) Inventors: James K. Miller, Ypsilanti, MI (US); Ricky L. Danks, Jackson, MI (US); Julian N. Smith, Farmington Hills, MI (US); Daniel Delaney, Pinckney, MI (US); George Grech, Garden City, MI (US); Forrest D. Butterwick, Ann Arbor, MI (US)

(73) Assignee: Thetford Corporation, Ann Arbor, MI (US)

( * ) Notice: Subject to any disclaimer, the term of this patent is extended or adjusted under 35 U.S.C. 154(b) by 0 days.

(21) Appl. No.: 13/470,599

(22) Filed: May 14, 2012

(65) Prior Publication Data

US 2012/0222206 A1 Sep. 6, 2012

Related U.S. Application Data

(62) Division of application No. 11/550,600, filed on Oct. 18, 2006, now Pat. No. 8,230,531.

(60) Provisional application No. 60/792,381, filed on Apr. 14, 2006, provisional application No. 60/727,754, filed on Oct. 18, 2005.

(51) Int. Cl.
*E03D 1/14* (2006.01)
*E03D 5/10* (2006.01)
*E03D 9/10* (2006.01)

(52) U.S. Cl.
CPC .. *E03D 5/10* (2013.01); *E03D 9/10* (2013.01); *E03D 2001/147* (2013.01)

(58) Field of Classification Search
USPC ..... 4/324, 319, 313, 345
See application file for complete search history.

(56) References Cited

U.S. PATENT DOCUMENTS 125,268 A * 4/1872 Miller ..... 62/398
3,878,569 A 4/1975 Peirish, Jr. et al.
4,032,995 A 7/1977 Kemper (Continued)

FOREIGN PATENT DOCUMENTS

GB 2137248 A 10/1984

OTHER PUBLICATIONS

Partial European Search Report for Application No. EP 06 02 1845, dated Jan. 14, 2009, 3 Pages.

(Continued)

*Primary Examiner* — Lauren Crane
(74) *Attorney, Agent, or Firm* — Harness, Dickey & Pierce, P.L.C.

(57) ABSTRACT

A control system for a flush toilet includes a water delivery device for delivering a source of flush water to a bowl. The control system includes a controller and a user interface. The controller is operative to control the toilet through a flush sequence in a first mode and a second mode. In the first mode, the controller opens the water delivery device to deliver a predetermined amount of water to the bowl. In the second mode, the controller opens the water delivery device to deliver a user adjustable amount of water to the bowl. The user interface is in communication with the controller for selecting between the first mode and the second mode. Where the toilet is a macerator toilet, the controller monitors current draw unit when the current draw satisfies a predetermined current condition. The controller may operate in a normal mode and a lockout mode.

6 Claims, 8 Drawing Sheets

(56) References Cited

U.S. PATENT DOCUMENTS

| | | | | | |
|---|---|---|---|---|---|
| 4,161,792 | A | | 7/1979 | Dallen et al. | |
| 4,162,656 | A | | 7/1979 | Dallen et al. | |
| 4,324,007 | A | | 4/1982 | Morris | |
| 4,651,359 | A | | 3/1987 | Battle | |
| 4,837,867 | A | * | 6/1989 | Miller | 4/324 |
| 5,123,124 | A | * | 6/1992 | Brower | 4/234 |
| 5,187,818 | A | * | 2/1993 | Barrett et al. | 4/313 |
| 5,469,586 | A | | 11/1995 | Tsutsui et al. | |
| 5,891,330 | A | | 4/1999 | Morris | |
| 6,408,448 | B1 | | 6/2002 | Jermier | |
| 6,534,940 | B2 | | 3/2003 | Bell et al. | |
| 6,745,407 | B1 | | 6/2004 | Van Acker, Jr. | |
| 7,028,347 | B2 | * | 4/2006 | Sanderson | 4/313 |
| 2003/0229939 | A1 | | 12/2003 | Berman | |
| 2007/0113330 | A1 | | 5/2007 | Miller et al. | |

OTHER PUBLICATIONS

Office Action regarding U.S. Appl. No. 11/550,600 mailed Nov. 22, 2011.

Office Action regarding U.S. Appl. No. 11/550,600 mailed Mar. 3, 2011.

Office Action regarding U.S. Appl. No. 11/550,600 mailed Jan. 4, 2011.

Office Action regarding U.S. Appl. No. 11/550,600 mailed Jul. 28, 2010.

* cited by examiner

FLUSH TOILET CONTROL SYSTEM AND RELATED METHOD

CROSS-REFERENCE TO RELATED APPLICATIONS

This application is a divisional of U.S. patent application Ser. No. 11/550,600 filed on 18 Oct. 2006. This application claims priority to U.S. Provisional Patent Applications No. 60/792,381 filed 14 Apr. 2006 and 60/727,754 filed 18 Oct. 2005, which applications are herein expressly incorporated by reference.

INTRODUCTION

The present teachings generally relate to waste management systems. More particularly, the present teachings relate to a flush toilet. More specifically, but without restriction to the particular embodiment and/or use which is shown and described for purposes of illustration, the present teachings pertain to a flush toilet control system and a related method for controlling the toilet.

Water for the operation of toilets is often limited or should otherwise be conserved. For example, vehicles including recreational vehicles ("RVs"), airplanes, boats, trains, and the like often include toilets for the comfort and convenience of the passengers. Such vehicle toilets rely on a source of on-board water for flushing. Additionally, vehicle toilets are generally evacuated to an on-board holding tank. The design of vehicle toilets must accommodate the distinct operating conditions and preferably provide the customer with the comforts and customary features associated with home toilets. Because vehicle toilets typically operate with an onboard source of water and this flush water is retained within an onboard holding tank, efficient use of the flush water is important for minimizing refilling of the flush water and for minimizing emptying of the holding tank. The amount of water used however, should preferably be adjustable to accommodate the needs of different users.

While known toilets have proven acceptable for their intended applications, there remains a need for continuous improvement in the pertinent art.

SUMMARY

According to one aspect, the present teachings provide a flush toilet control system. The flush toilet control system includes an electronic controller and is operative in a first mode and a second mode. In the first mode, the system is actuated to flush the toilet with a predetermined amount of water. In the second mode, the user can adjust the amount of water delivered to the toilet and the controller can be automatically reprogrammed to repeat this adjusted amount of water during subsequent operating of the system in the first mode.

According to another aspect, the present teachings provide a system for monitoring current drawn by a macerator unit of a macerator toilet. The system may include a controller for discontinuing power to the macerator unit upon sensing a current outside a predetermined range. In this regard, the controller may discontinue power to the macerator unit upon sensing a current below a first predetermined current. The controller of the system may be additionally or alternatively operative for discontinuing power to the macerator unit upon sensing of a current above a second predetermined current.

According to another aspect, the present teachings provide a control system for a flush toilet, the control system includes a controller and a user interface. The controller is operative to control the toilet to perform a flushing sequence. The controller is further operative in a normal mode and a lockout mode. The user interface is in communication with the controller. The user interface is operative to initiate the flushing sequence when the controller is in the normal mode and inoperative to initiate the flushing sequence when the controller is in the lockout mode.

Further areas of applicability of the present teachings will become apparent from the detailed description provided hereinafter. It should be understood that the detailed description and specific examples, while indicating the various aspects of the present teachings, are intended for purposes of illustration only and are not intended to limit the scope of the invention.

DRAWINGS

The present teachings will become more fully understood from the detailed description and the accompanying drawings, wherein.

DESCRIPTION OF VARIOUS ASPECTS

The following description of the present teachings is merely exemplary in nature and is in no way intended to limit the present teachings, its application, or uses.

Figure 1:
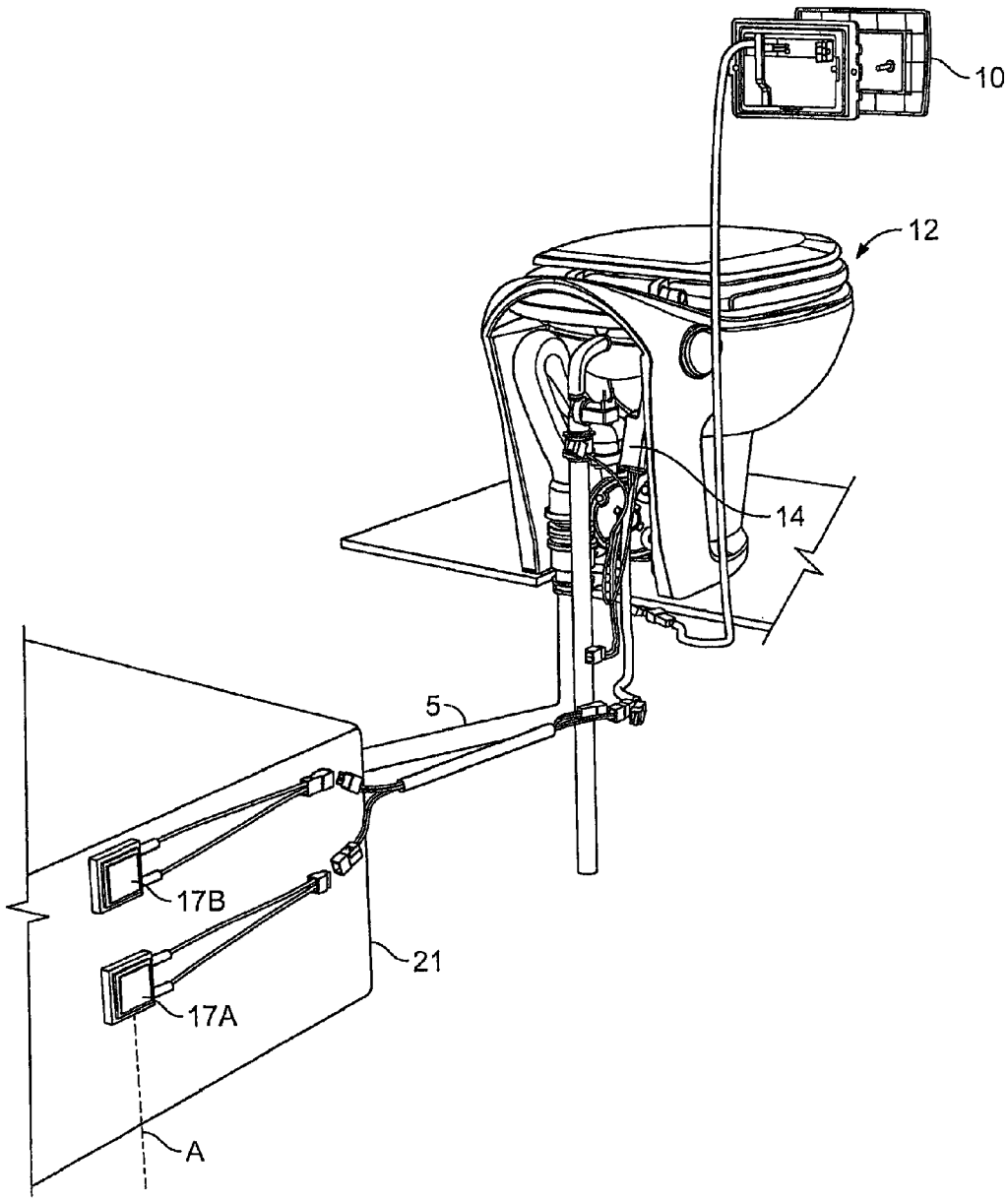
FIG. 1 is a perspective view of a waste transfer arrangement incorporating a flush control system in accordance with the present teachings.
Figure 2:
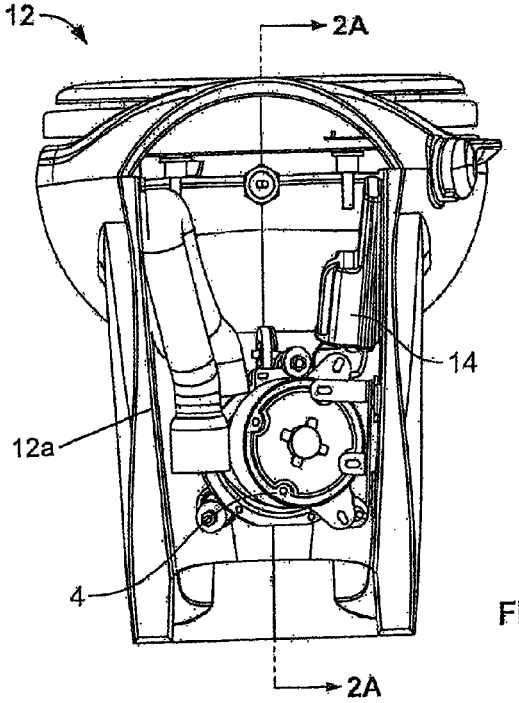
FIG. 2 is a rear view of the toilet of FIG. 1.
Figure 2A:
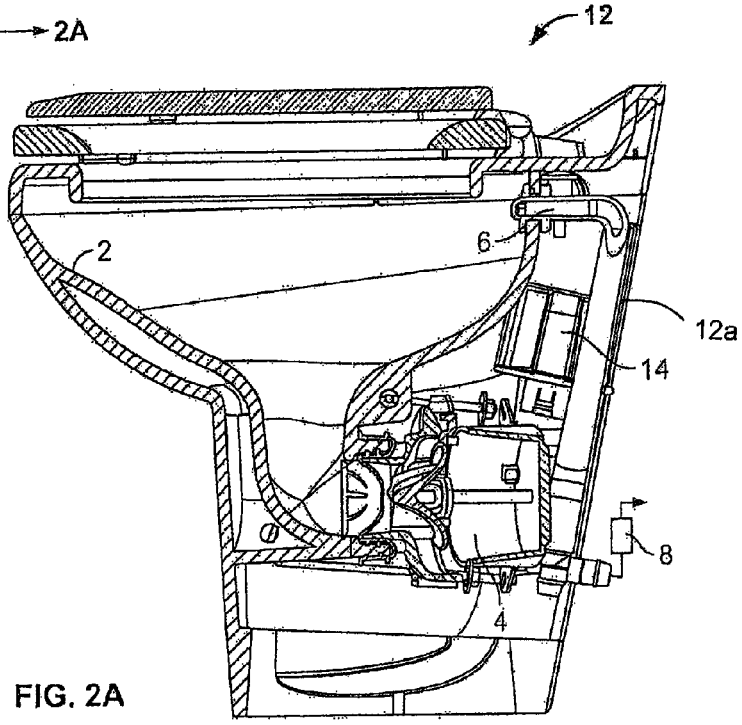
FIG. 2A is a cross-sectional view taken along the line 2A-2A of FIG. 2.

With initial reference to FIG. 1, a waste transfer arrangement incorporating a flush control system in accordance with the present teachings is illustrated. The waste transfer arrangement is shown to generally include a toilet 12 and a waste holding tank 2 for receiving waste from the toilet 12. The waste transfer arrangement is further shown to include a controller 14 for electronically controlling the flushing operation of the toilet 12 and a user interface 10 for operating the controller 14.

With continued reference to FIG. 1 and additional reference to the remaining drawings, the present teachings will be further described. The toilet may be a macerator toilet 12. One suitable toilet for use with the present teachings is shown and described in further detail in U.S. Ser. No. 60/791,953 entitled Macerator Toilet and filed on 13 Apr. 2006. U.S. Ser. No. 60/791,953 is hereby incorporated by reference as if fully set forth herein. It will be appreciated, however, that various of the present teachings may be utilized with other types of toilets, including non-macerating toilets.

The toilet 12 may include a housing 12*a* that includes a nozzle 6 for delivering a source of flush water to the bowl 2. The nozzle 6 is in communication with a source of flush water through a water delivery device 8. The water delivery device 8 may be a water pump that is activated to pump the flush water to the toilet 12, a water valve that allows a source of pressurized flush water to be delivered to the toilet 12, or any other known device for selectively delivering flush water to the toilet 12.

The toilet 12 may further include a macerator unit 4 located within the housing 12*a* such that it forms an integral portion of the toilet 12. The macerator unit 4 is in communication with the bowl 2. The macerator unit 4 receives waste from the bowl 2 and processes the waste prior to transfer to the holding tank 21 through a waste conduit 5 (FIG. 1). The macerator unit 4 may macerate the waste and may pump the waste to the holding tank 21. As used herein, the term "process" when referencing operation of the macerator unit 4 shall mean macerate, pump or both.

As will become more apparent below, the electronic controller 14 of the present teachings cooperates with the user interface 10 for electronically controlling the operation of the toilet 12. In this regard, the electronic controller 14 may function to prevent flushing of the toilet in certain circumstances. The electronic controller 14 may be operated in various modes depending upon the operating conditions (e.g., whether the holding tank 21 is full or not) and depending on preferences of the user.

The electronic controller 14 may use FLASH technology for the programming of program changes. Alternatively, the electronic controller may be a programmable logic controller 14. Other types of controllers 14 may also be employed within the scope of the present teachings.

The user interface 10 may be located remotely from the toilet 12. In this regard, the user interface 10 may be incorporated into a wall-mounted unit. Alternatively, the user interface 10 may be carried on the toilet 12. The user interface 10 may include a microchip. In such an arrangement, the electronic controller 14 may be carried by the toilet 12 and connected to the user interface 10 by a pair of wires. The polarity and length of the wires may be inconsequential. This will allow an original equipment manufacturer (OEM) of an associated vehicle to wire the user interface 10 to the controller 14 without worrying about whether the wire polarity or lengths are correct. The communication scheme of the system may also be bidirectional.

The user interface 10 may be powered by the controller 14. In this regard, the controller 14 may send the user interface 10 a voltage output signal. The voltage output signal may be dropped to near zero by a software routine. By storing energy in the user interface 10 and switching the power off and on very quickly, a communications signal is established while maintaining power in the user interface 10. By making the on-off pulses very fast, a change in power at the user interface 10 is not user perceptible.

The user interface 10 may cooperate with the controller 14 to provide two primary functions. A first primary function is an ADD WATER function that adds water to the bowl 2 prior to initiation of a flush sequence. The ADD WATER function may add a predetermined amount of water to the bowl 2. The second primary function is a FLUSH function to initiate a flushing sequence. To facilitate such control of the toilet 12, the user interface 10 may include one or more manually controlled elements. As shown particularly in FIG. 3, the user interface 10 may include a first manually controlled element 16 and a second manually controlled element 18. The first and second manually controlled elements may be first and second buttons 16 and 18.

Figure 3:
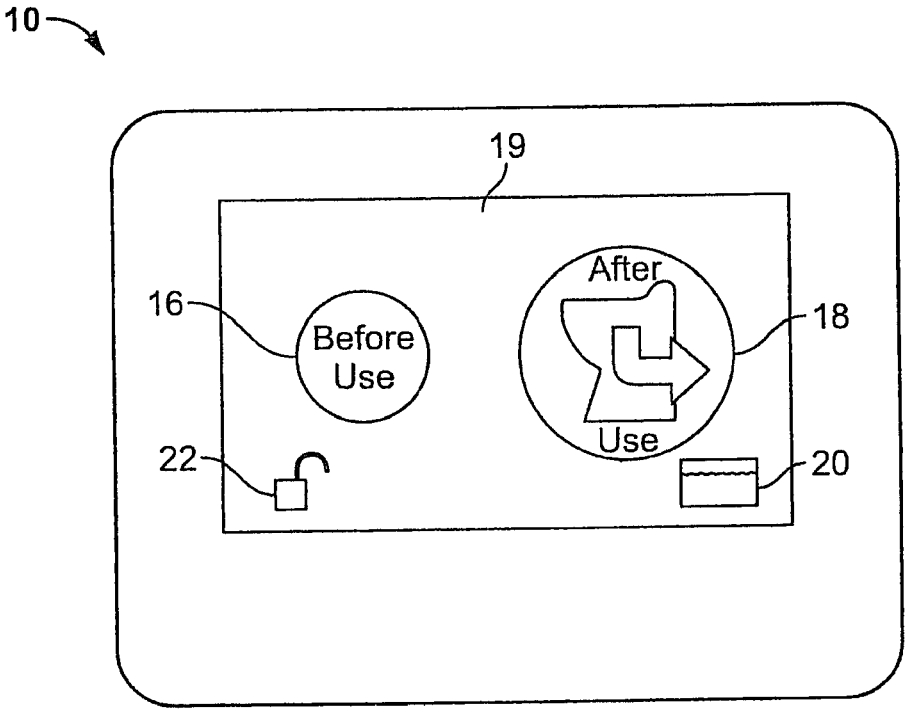
FIG. 3 is a front view of a user control interface for a control system for a flush toilet according to the present teachings.
Figure 5A:
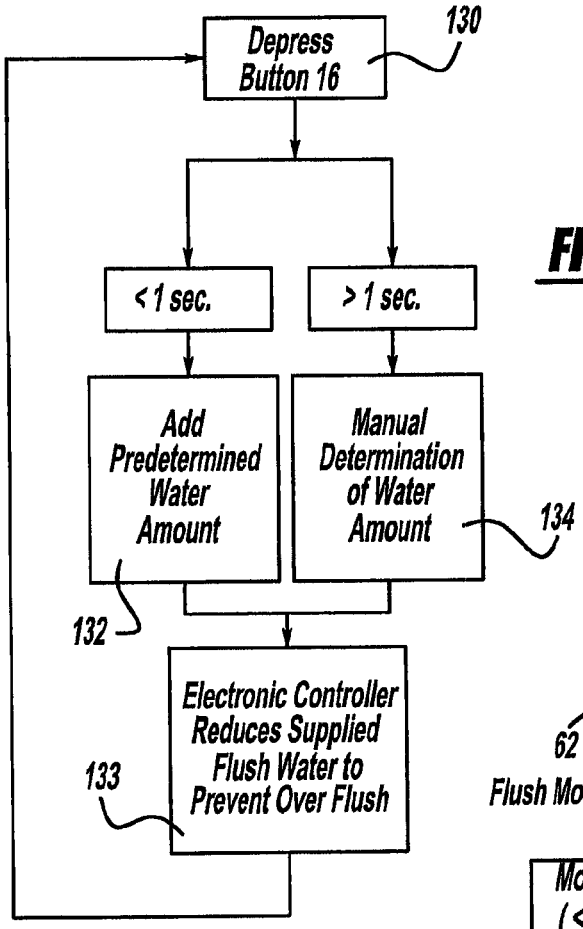
FIG. 5A is a flow diagram illustrating control of the system to ADD WATER to the bowl of the toilet.

Operation of the system to ADD WATER will be further described with particular reference to FIG. 3 and the flow diagram of FIG. 5A. The operation to "Add Water" is introduced by manually depressing the first button 16 at step 130. If the first button 16 is depressed for less than a predetermined amount of time (e.g., one second), the electronic controller 14 will add a predetermined amount of "add water" to the bowl 2 (e.g., 0.5 L) at step 132. If the first button 16 is pressed again, another predetermined amount of "add water" will be introduced to the bowl 2. The electronic controller 14 may function to subtract the total amount of "add water" from the flush water to prevent an over flush of the system, as indicated at step 133.

If the first button 16 is depressed for longer that the predetermined time, a greater amount of "add water" may be introduced to the bowl 2. The amount of "add water" may be manually determined at step 134. The introduction of "add water" may cease either when depression of the first button 16 is discontinued or when a maximum amount of add water is introduced. Again, the electronic controller 14 may subtract the total amount of add water from the flush water to prevent an over flush.

Figure 5B:
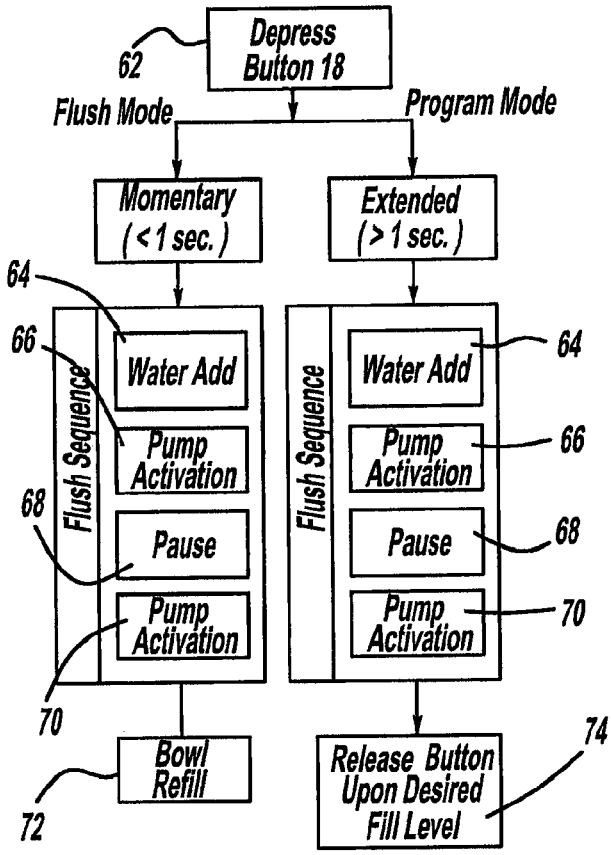
FIG. 5B is a flow diagram illustrating control of the system to initiate a flush sequence for the toilet.

Operation of the system to flush the toilet 12 will be further described with reference to FIG. 3 and the flow diagram of FIG. 5B. Flushing of the toilet 12 through a flush sequence is initiated through depression of the second button 18 at step 62. The controller 14 may selectively control the toilet 12 to operate in one of a "Flush" mode or a "Program" mode. In this regard, the "Flush" mode can be activated if the button 18 is momentarily pressed (e.g., for less than one second). The "Program" mode can be activated where the button 18 is depressed for longer than a predetermined time (e.g., more than one second, for example).

In the "Flush" mode, the water delivery device 8 of the toilet 12 is controlled by the controller 14 to deliver a predetermined amount of pre-flush water (e.g., 0.25 L) to the bowl 2 of the toilet 12 at step 64. The macerator unit 4 of the toilet 12 is activated at step 66 by closing of a macerator circuit (not shown) and the contents of the bowl 2 are macerated. The macerator unit 4 may be paused at step 68 and then reactivated for further maceration at step 70. At step 72, the controller 14 functions to open the water delivery device 8 to deliver a predetermined amount of post-water to the bowl 2. The predetermined amount of water may be a minimum amount of water needed to run the macerator unit 4 (e.g., 0.5 L). Where the toilet 12 includes a flush valve, the controller 14 may also control opening of the flush valve (not particularly shown).

In the "Program" mode, the user maintains depression of the second button 18 throughout the flush cycle and releases the button 18 at step 74 upon achieving a desired refill level in the bowl of the toilet 12. A backlight of the user interface 10 may be controlled by the controller 14 to flash until the button 18 is released. The controller 14 is automatically reprogrammed to remember the level of this setting for all future flushes until the level is reset through entry of the "Program" mode. The controller 14 may limit a maximum amount of water delivered to the bowl 2. Steps 64-70 described above are substantially identical for the flush sequence of the Program mode.

For certain applications, the system may be operated in two modes of operation. In this regard, the system may be operated in a first mode or "marine" mode and a second mode or "residential" mode. The controller 14 may be shipped to the customer in the marine mode. The marine mode may leave the bowl 2 of the toilet 12 with a minimal amount of water in the trap at the bottom of the bowl 2. The residential mode may leave the bowl with a greater amount of water in the bowl 2, similar to a residential (i.e., home) toilet.

Figure 5C:
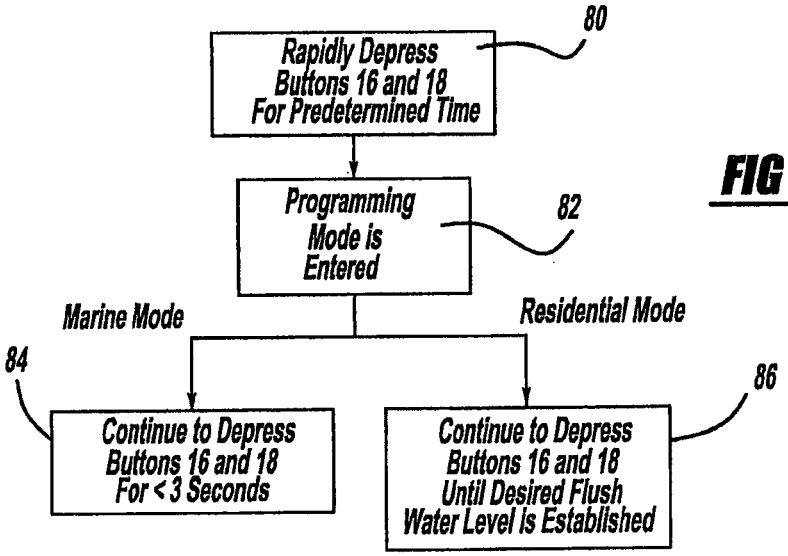
FIG. 5C is a flow diagram illustrating control of the system in a water refill programming mode.

Operation of the system in a particular water programming mode will be described with reference to the flow diagram of FIG. 5C. At step 80, the user depresses the buttons 16 and 18 for a predetermined time (e.g., 3 sec.). At step 82, the controller 14 enters the programming mode. At step 84, the user continues to depress the buttons 16 and 18 for less than 3 seconds, for example, and the marine mode is entered. In the marine mode, the controller 14 will function to operate the water delivery device 8 to refill only the trap at the bottom of the bowl 2. If the user continues to depress the buttons at step 86 for longer than 3 seconds, the residential mode is entered and the controller 14 sets the amount of water that will be used for future flushes until otherwise re-programmed. The controller 14 may limit a maximum amount of water delivered to the bowl 2.

In certain circumstances, it may be desirable to empty the bowl 2 of water without starting a flush sequence. The controller 14 may operate to empty the bowl in this manner through simultaneous depression of both buttons 16 and 18 between two predetermined times. For example, the controller 14 may operate to empty the bowl where the user depresses both buttons for a time greater than 0.5 sec. and less than 3.0 sec.

The control system of the present teachings may include a tank level sensing arrangement. The sensing arrangement may include one or more sensors 17 for sensing the level within a waste holding tank 21. The tank level sensors 17 may include a plurality of reed switches, for example. Alternatively, the tank level sensors 17 may be of any other type well known in the pertinent art, including but not limited to resistors.

The tank level sensors 17 may be conventionally operable to sense various levels within the holding tank 21. As shown in FIG. 1, the sensing arrangement may include a first sensor 17A and a second sensor 17B. The first sensor 17A may be mounted along a tank centerline A and positioned proximate a horizontal center of the tank 21. The second sensor 17B may be mounted along the tank centerline A at the highest point on the tank for the tank's capacity or where the user desires to be provided with a "tank full" indication. As will be discussed further below, the sensors 17A and 17B operate to send a convention signal to the controller 14 and may illuminate an appropriate indicator on the user interface, for example. The indicators 17A and 17B may inform the user that the tank is half-full or substantially full, for example. In the event that one or both of the sensors 17A and 17B fails (e.g., shorted or open), the controller 14 may function to lockout the system in the manner discussed below.

As shown in FIG. 3, for example, the user interface 10 may include a first indicator 20 for indicating a level of waste in the holding tank 21. The first indicator 20 may cooperate with the tank level sensors 17A and 17B and the electronic controller 14 to differentiate between the various levels within the holding tank 21, e.g., when the holding tank 21 is empty, half full and substantially (or completely) full. The indicator 20 may comprise a graphical representation of a holding tank which may be illuminated in various colors depending on the available capacity. For example, the indicator 20 may be illuminated in a first color (e.g., yellow) when the holding tank 21 is half full, a second color (e.g., red) when the holding tank is substantially full, and a third color (e.g., green) when the holding tank 21 is less than half full. As will be discussed below, where the control system includes tank level sensors 17, the control system may be automatically operated by the controller 14 in the "Lockout" mode upon sensing of a tank level above a predetermined level (e.g., approximately 90% full).

The control system may operate in an "Operational" mode and a "Lockout" mode. In the operational mode, the system is fully functional as described above. In the lockout mode the system is temporarily disabled and normal operation of the toilet 12 is prevented.

The user interface 10 may include a second indicator 22 for indicating when the system is functional or when the system operates in the operational mode. The indicator 22 may comprise a graphical representation of a lock (shown unlocked) which may be illuminated (e.g., illuminated in red) by the controller 14 when the system is overridden in the manner discussed below. When the system is in the lockout mode, the indicator 22 is not illuminated by the controller 14 and the controller 14 illuminates the second indicator 20 in red, for example.

Figure 5D:
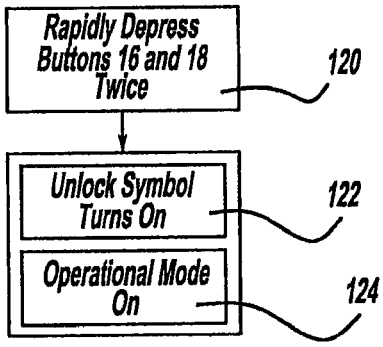
FIG. 5D is a flow diagram illustrating control of the system to enter an operational mode.

As discussed above, the system will normally operate in the lockout mode when the holding tank 21 becomes substantially full. In such a condition, the operator may toggle from the lockout mode to the operational mode. As shown in the flow diagram of FIG. 5D, the operational mode may be entered through depression of the buttons 16 and 18. For example, the controller 14 may function to enter the operational mode where the user simultaneously presses both buttons 16 and 18 in rapid succession. This action, which is shown at step 120, turns on the indicator 22 (e.g. unlock symbol) at step 122 and enables the operational mode at step 124.

Figure 5E:
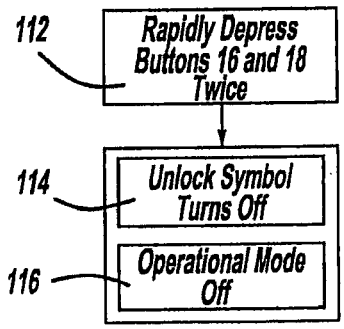
FIG. 5E is a flow diagram illustrating control of the system to enter a lockout mode.

In the operational mode, the user can similarly return the controller 14 to the lockout mode. As shown in FIG. 5E, the locked mode may be re-entered through depression of the buttons 16 and 18. For example, the controller 14 may function to enter the operational mode where the user simultaneously presses both buttons 16 and 18 in rapid succession. This action, which is shown at step 112, turns off the indicator 22 (e.g. unlock symbol) at step 114 and turns off the operational mode (e.g., enables the locked mode) at step 116.

The user control interface 10 may operate in "Sleep" mode in which the backlighting is turned off. The "Sleep" mode may be automatically activated by the electronic controller 14 if there is no button activity for a predetermined amount of time (e.g., 8 hours). During the "Sleep" mode, the electronic controller 14 may control a backlighting and relevant icons to flash at predetermined intervals (e.g., 3 seconds) and at a reduced luminosity (e.g., 50%) until reactivated. During the "Sleep" mode, the electronic controller 14 may continue to perform system checks and update indicators. Depression of any button may operate to activate normal backlighting and exit the sleep mode.

Figure 5F:
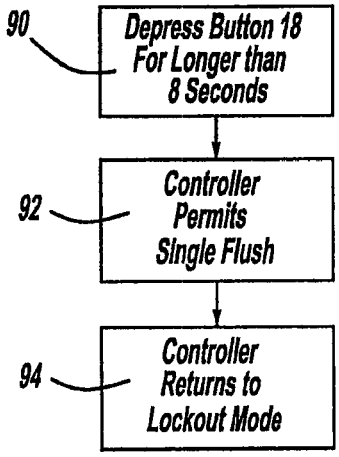
FIG. 5F is a flow diagram illustrating control of the system to override the lockout mode.

The electronic controller 14 may also control the system in a "Temporary Override" mode or "Limp Home" mode. As discussed above, where the sensor 17B indicates that the holding tank 21 is substantially full, the system will operate in the lockout mode and normal operation of the toilet 12 will be disabled. This lockout mode may be overridden for emergency use of the toilet 12. Because the sensor 17B is not located at the exact top of the tank 21, the controller 14 may function to allow a limited number of flushes (e.g., 5) after the sensor 17B locks the system out. The size and shape of the holding tank 21 will determine the actual number of times this can be done without over flow. In this regard, the first and second buttons 16 and 18 may be depressed for an extended period (e.g., eight seconds) to allow a limited number of additional (e.g., one) flushes of the system. This action is shown in the flow diagram of FIG. 5F at step 90. At step 92, the controller 14 permits a single flush. At step 94, the electronic controller 14 will return the system to the "Lockout" mode unless again overridden in this manner. The controller 14 may operate to limit the number of times that the system may be overridden in this manner.

Figure 6:
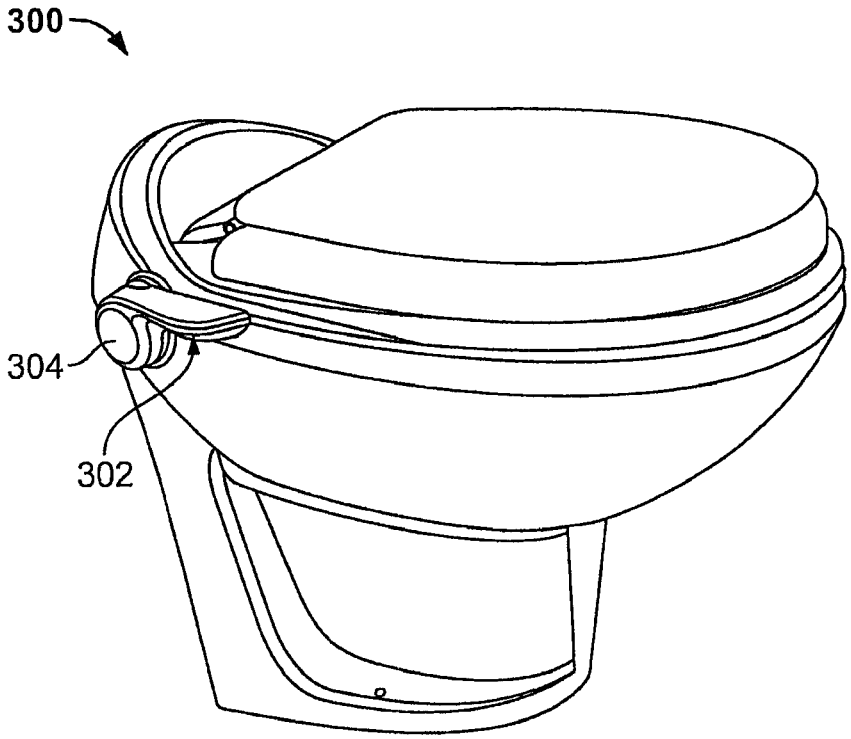
FIG. 6 is a perspective view of a flush toilet according to the present teachings.
Figure 7:
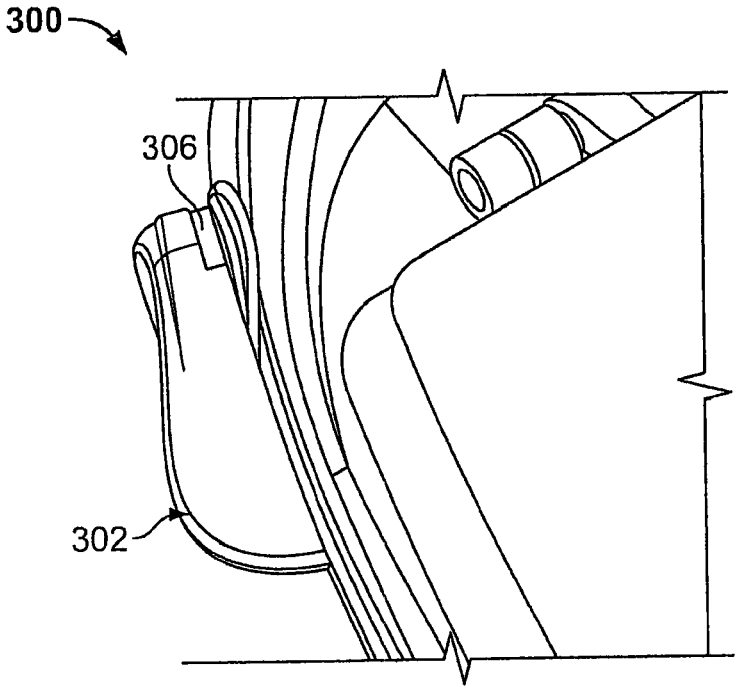
FIG. 7 is an enlarged view of a portion of the flush toilet of FIG. 8.

Turning to FIGS. 6 and 7, a flush toilet constructed in accordance with the present teachings is illustrated and generally identified at reference character 300. In this embodiment, a handle 302 may be rotated upwardly for electronically controlling the system to add water. The handle 302 may be rotated downwardly for electronically controlling the system to flush. The handle 302 may be spring biased to a neutral position.

A base 304 of the handle 302 may include reed switches. The handle 302 may include magnets which cooperate with the reed switches to generate a signal indicative of the position of the handle 302. This signal is sent to the electronic controller 14. The toilet 300 may otherwise be controlled by the electronic controller 14 substantially in the manner discussed above.

The handle 302 may include an indicator 306 for indicating when the holding tank is substantially full. The indicator 306 may be an LED that illuminates (e.g., in red) when the holding tank is substantially full.

Figure 4:
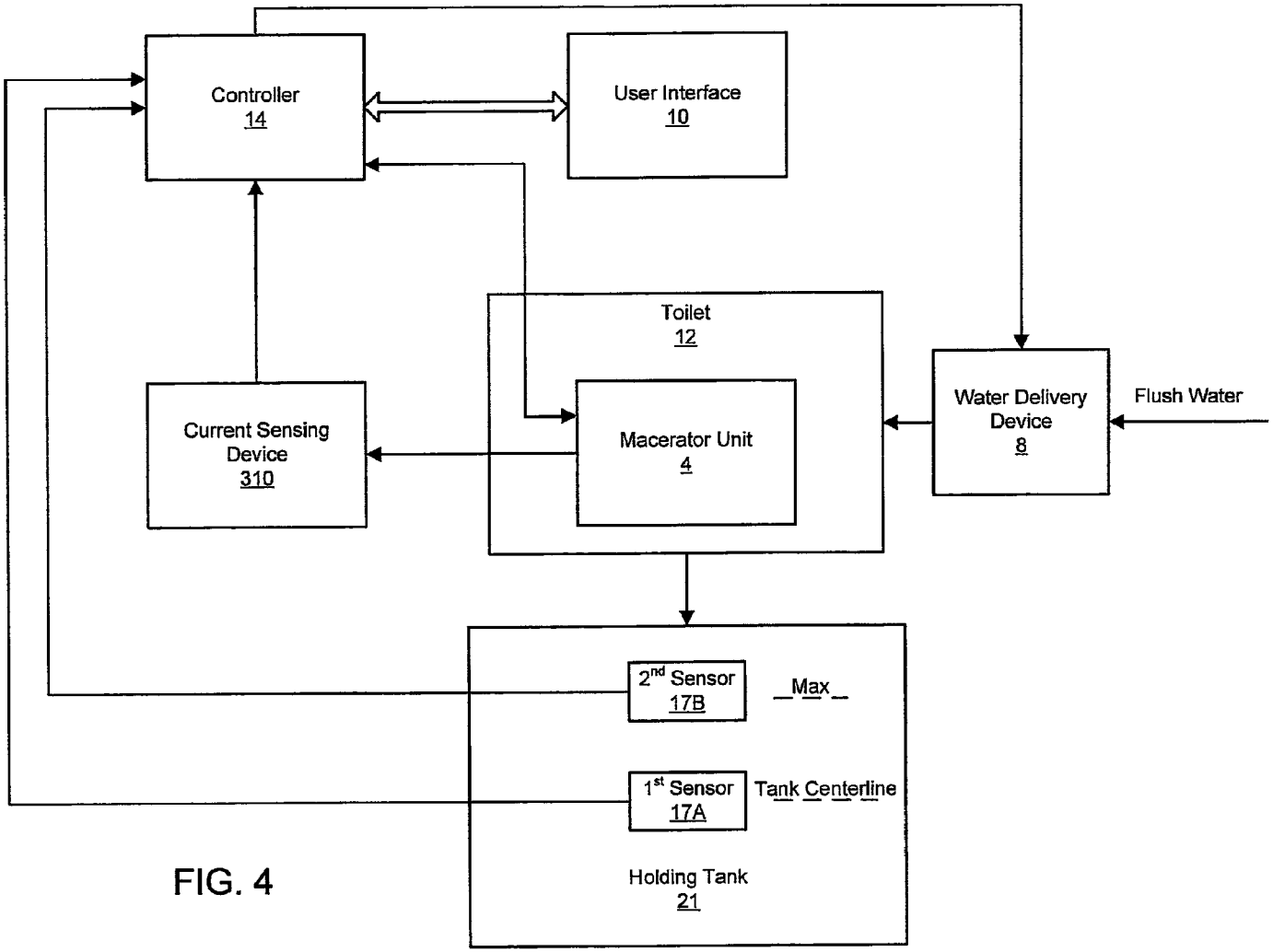
FIG. 4 is a simplified schematic view illustrating the control interface operatively associated with the flush toilet for controlling the flush toilet with an electronic controller.
Figure 8:
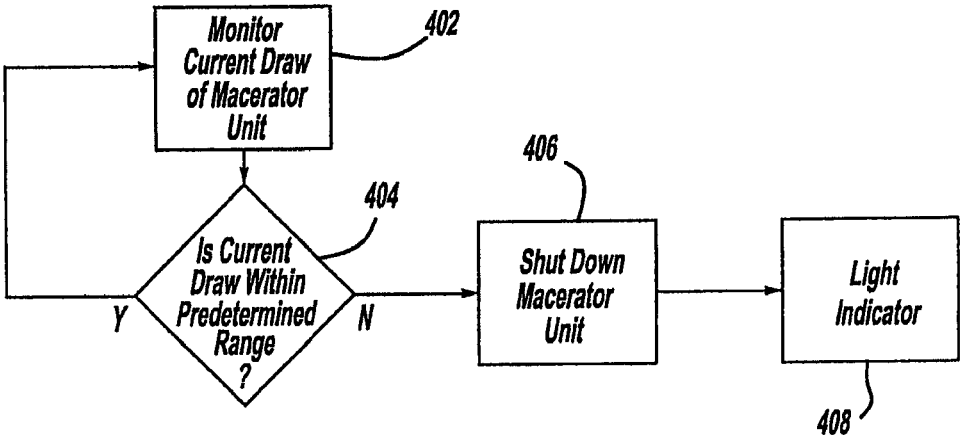
FIG. 8 is a flow chart illustrating a method of monitoring current drawn by a macerator unit in accordance with the present teachings.

Turning to the flow diagram of FIG. 8, the present teachings are shown to further include a method 400 for monitoring current drawn by the macerator unit 4 of the macerator toilet 12 and shutting down the macerator unit 4 upon identification of a predetermined current condition. Monitoring of the current may be accomplished with a current sensing device 310 (see FIG. 4) and may provide value added functionality to the toilet 12. Current drawn by the macerator unit 4 during normal macerating of waste may be associated with an expected low current and an expected high current. When waste maceration is completed and the macerated waste is pumped from the macerator unit 4, the current drawn by the macerator unit 4 will drop below a first pre-determined current or the expected minimum low current. Such a current drop may be indicative of an unloaded state or empty macerator unit 4. Conversely, when the macerator unit 4 fails due to pump plugging, a locked rotor or related condition, the current drawn by the macerator unit 4 will rise above a second predetermined current or the expected maximum current.

The current sensing device 310 may be a current sensing circuit. The current sensing circuit may divert current through a resistor to conventionally monitor a change of voltage across the resistor. Alternatively, any other known manner of monitoring the current drawn by the macerator unit 4 may be used with the present teachings.

In operation, the system may continually monitor current drawn by the macerator unit 4 in a first step 402. In a second step 404, the controller 14 determines whether the drawn current is within a predetermined range. At step 406, the controller 14 operates to shut down the macerator unit 4 if the current drawn is outside the predetermined range. For example, where the current draw is below the first predetermined current, the electronic controller 14 may open the macerator unit circuit and thereby discontinue operation of the macerator unit 4. In this manner, noise generated by the toilet 12 will be reduced as unneeded macerator operation is avoided. In response to a current draw above the second predetermined current, the electronic controller 14 may similarly open the macerator unit circuit and thereby discontinue operation of the toilet.

At step 408, the electronic controller 14 may activate a visual indicator to indicate failure of the macerator unit 4 where the current draw is above the predetermined range. The electronic controller 14 may further function to prevent normal flushing of the toilet 12 and thereby prevent the possibility of flooding. The microcontroller may store a notice of failure in memory should the macerator unit 4 not fulfill its normal operation. The system may include a user override function similar to that described above to ensure that a user can continue to add water to the bowl 2 regardless of the control settings.

Alternatively, the controller 14 may function to monitor an operating characteristic of the current and subsequently shut the power off to the macerator unit 4. In this regard, the controller may monitor for a drop in current to the macerator unit 4. Such a condition may indicate that operation of the macerator unit 4 is no longer required. Initial power up of the macerator unit 4 may be ignored.

According to another aspect, the present teachings include a system for monitoring input power to affect certain software subroutines. Through the monitoring of input power, the system may halt, resend or end any of its processes in order to prevent deleterious effects to the controller. The system may include an alert such as a visual indicator for notifying a user of a problem with a low voltage condition. For example, the visual indicator may include flashing of LEDs of a wall switch in a prescribed fashion. If the input power drops below a level that may cause controller malfunction, the system may reset the entire controller and the wall switch independently.

An EEPROM of the microcontroller may be used to store certain information important to the understanding of various operating conditions of the toilet 12. Such information may include a total number of flushes, number of flooding conditions, software revision and production date, overvoltage/undervoltage conditions and motor time-outs, among other conditions.

The description of the present teachings is merely exemplary in nature and, thus, variations that do not depart from the gist of the invention are intended to be within the scope of the invention. Such variations are not to be regarded as a departure from the spirit and scope of the invention. Furthermore, the present invention has been described with reference to particular embodiments having many common and some distinct features. One skilled in the art will recognize that these features may be used singularly or in any combination based on the requirements and specifications of a given application or design.

The invention claimed is:

1. A control system for a flush toilet including a water delivery device for delivering a source of flush water to a bowl, the control system comprising:

an electronic controller;

a user interface in communication with the controller, the user interface including a single user engageable control located for ready access by a user and operative to control the toilet through a flush sequence, such that when: the single user engageable control is pressed for a duration less than a predetermined time duration, the controller implements a flush mode in which a flush operation for the toilet is initiated, and when the single user engageable control is held depressed for a time duration longer than the predetermined time duration a program mode is initiated which also includes initiating a flush operation for the toilet;

wherein in the flush mode the controller operates the water delivery device to deliver a first predetermined amount of water to the bowl during the flush operation;

wherein in the program mode the controller operates the water delivery device to deliver a user adjustable amount of water to the bowl during the flush operation that sets a new water level for the bowl in accordance with a time duration that the user holds the user engageable control pressed, the controller remembering the new water level setting for future flushes;

the controller configured to control the user interface to provide an optical signal to the user while the program mode is in use, until the user releases the user engageable control; and wherein after exiting the program mode and returning to the flush mode, the controller uses the user adjustable amount of water that was set by the user during the program mode to refill the bowl to the new water level for each one of all subsequent flushes that are performed by the user when initiating the flush mode.

2. The control system of claim 1, in combination with the toilet.

3. The control system of claim 2, wherein the toilet is a macerator toilet.

4. The control system of claim 1, wherein the controller is controllable by the user interface to deliver a second predetermined amount of water to the bowl prior to the flush sequence.

5. The control system of claim 4, wherein the controller subtracts the second predetermined amount of water from the first predetermined amount of water for subsequent operation in the flush mode.

6. A control system for a flush toilet including a water delivery device for delivering a source of flush water to a bowl, the control system comprising:

an electronic controller;

a user interface having a user depressible control in communication with the electronic controller and located for ready access by the user;

the electronic controller and the user depressible control operative to control the toilet through a flush sequence;

wherein in a flush mode, the electronic controller initiates a flush operation when the user depressible control is detected as having been depressed and held in a depressed position for less than a predetermined time interval by the user, wherein a program mode is initiated by the electronic controller when the user depressible control is depressed and held in the depressed position for a time duration longer than the predetermined time interval, the program mode also operating to initiate a flush operation, and when in the flush mode the electronic controller operates the water delivery device to deliver a first predetermined amount of water to the bowl during the flush operation;

when in the program mode the electronic controller both initiates the flush operation and further operates the water delivery device to deliver a user adjustable amount of water to the bowl which is set in accordance with a time duration that the user holds down the user depressible control, to define a new water level setting for the bowl;

the electronic controller further configured to control the user interface to provide an optical signal to the user while the program mode is in use, until the user releases the user depressible control;

wherein after exiting the program mode and returning to the flush mode, the electronic controller remembers the new water level setting and uses the user adjustable amount of water that was previously selected during the program mode for all subsequent flushes which are performed whenever the user initiates the flush mode; and wherein the controller limits an amount of water that may be added to the bowl by the user during the program mode.

* * * * *